United States Patent [19]

Williamson

[11] 4,284,391

[45] Aug. 18, 1981

[54] CRASHWORTHY FUEL PUMP IMPROVEMENT

[75] Inventor: Raymond E. Williamson, Granite City, Ill.

[73] Assignee: ACF Industries, Inc., New York, N.Y.

[21] Appl. No.: 80,264

[22] Filed: Oct. 1, 1979

[51] Int. Cl.[3] ..... F04B 39/10

[52] U.S. Cl. ..... 417/569

[58] Field of Search ..... 417/470, 471, 569, 570, 417/571; 137/543.17

[56] References Cited

U.S. PATENT DOCUMENTS

| | | | |
|---|---|---|---|
| 3,878,861 | 4/1975 | Pareja | 137/543.17 |
| 4,153,394 | 5/1979 | Nakada | 417/571 |

*Primary Examiner*—William L. Freeh

*Attorney, Agent, or Firm*—J. Joseph Muller

[57] ABSTRACT

A crashworthy fuel pump improvement comprises a control valve having a valve seat pressed into the fuel discharge cavity of the fuel pump. The valve seat is of a heat treated material and a seal is formed between the seat and the wall of the cavity to prevent fuel leaks in the event of a crash.

2 Claims, 2 Drawing Figures

CRASHWORTHY FUEL PUMP IMPROVEMENT

BACKGROUND OF THE INVENTION

This invention relates to fuel pumps and, more particularly, to a crashworthy fuel pump capable of withstanding extreme forces such as occur during a crash without leaking fuel.

Because of their location in the engine compartment of an automobile, fuel pumps are susceptible to damage during a crash as the result of being struck by debris flying about in the compartment. As a consequence, fuel leaks from the pump may occur. The presence of gasoline in the engine compartment due to a broken fuel pump creates a great risk of fire and potential harm to both the vehicle and its occupants.

Federal Motor Vehicle Safety Standard (FMVSS) 30 was issued in an attempt to reduce the hazards attendant the location of the fuel pump in the engine compartment by requiring that the risk of damage to a fuel pump during a crash be minimized. To comply with this standard, various schemes have been proposed to shield the fuel pump or otherwise protect it from flying debris. However, these protective shields add weight to the vehicle, may be difficult to fit into already crowded engine compartments, and may not always prevent an object from striking a fuel pump.

SUMMARY OF THE INVENTION

Among the several objects of the present invention may be noted the provision of a fuel pump improvement which enhances the crashworthiness of the pump and the provision of such an improvement to aid in preventing fuel leaks when the fuel pump is deformed as the result of an accident.

Briefly, the improvement of the present invention comprises a control valve positioned in the fuel discharge of a fuel pump, the control valve having a valve seat pressed into the portion of the fuel pump body forming the fuel discharge cavity. The valve seat has a central, circular opening therein and means are provided for sealing the valve seat and the body. Other objects and features will be in part apparent and in part pointed out hereinafter.

BRIEF DESCRIPTION OF THE DRAWINGS

Corresponding reference characters indicate corresponding parts throughout the several views of the drawings.

DESCRIPTION OF A PREFERRED EMBODIMENT

Figure 1:
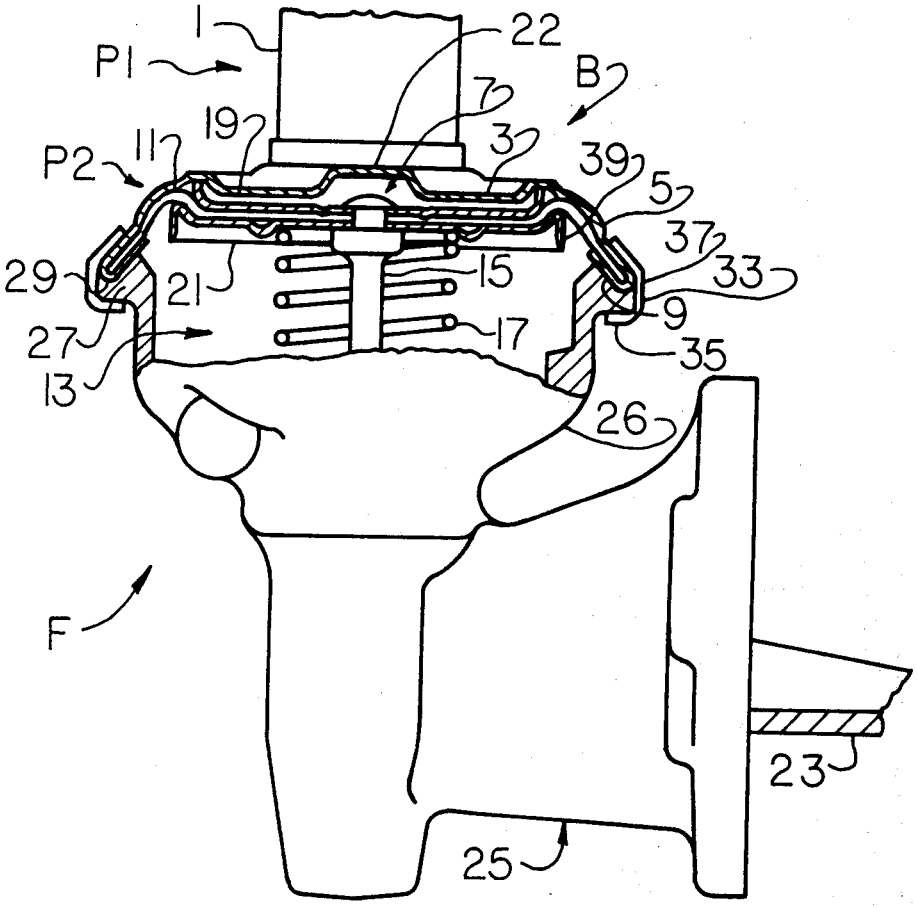
FIG. 1 is a sectional view of a crashworthy fuel pump installable in the engine compartment of a vehicle.

Referring to the drawings, a crashworthy fuel pump F for use in an automotive fuel system comprises a pump body, generally indicated B, which is of one-piece, thin-walled, sheet metal construction. Body B has a first portion P1 in which are formed two integral deep-drawn cylindrical cup-shaped projections, one of which is partially shown in FIG. 1, and is indicated by reference numeral 1. One of the projections defines an intake cavity for the fuel pump and the other projections defines a discharge cavity for the pump (see FIG. 2). A properly oriented check valve (not shown) is located in each cavity to control fuel flow into and out of the fuel pump and appropriate fittings (also not shown) are located at the outer end of each projection for connecting the fuel pump into the fuel system. Check valves and fittings of the type shown in U.S. Pat. No. 3,096,722 to Fitzgerald et al, issued July 9, 1963, are illustrative of those which may be used in fuel pump F.

Body B has a second portion P2 of a shallow cup shape, having an end wall 3 and a flaring annular peripheral wall 5 forming a fuel pumping chamber 7. One end of each cavity 1 is in fluid communication with the pumping chamber. The lower end of body portion P2 is open and a lip 9 is formed around the periphery of this open end.

Figure 2:
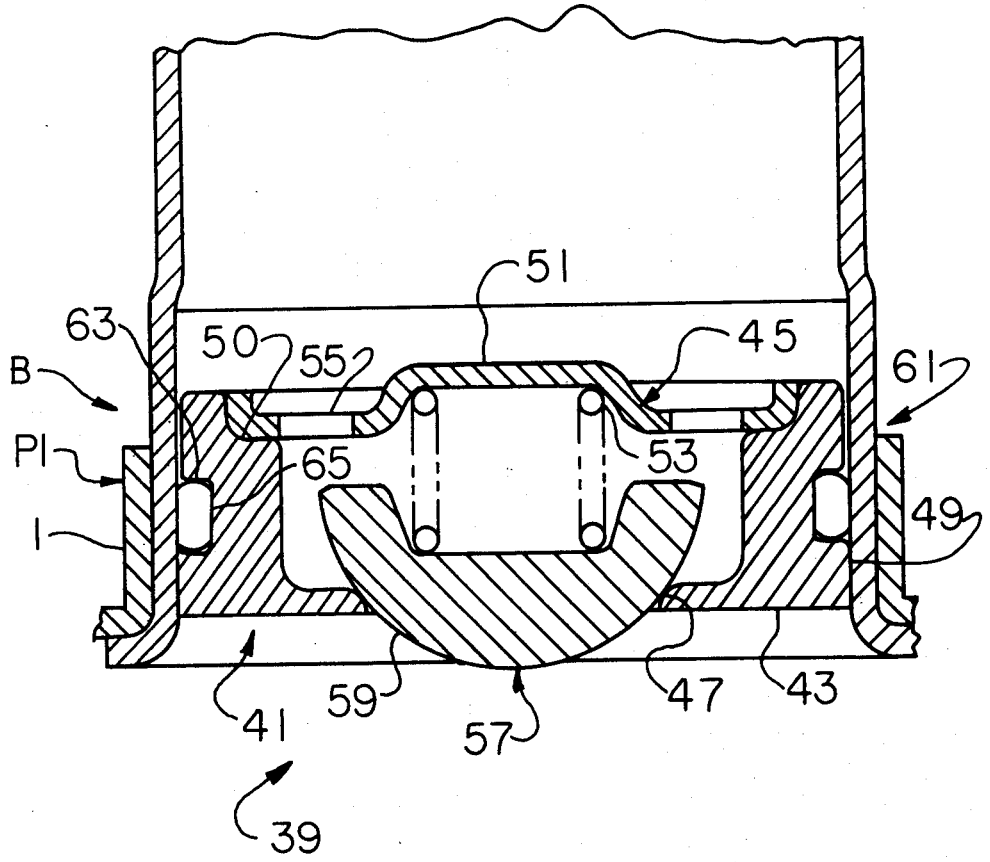
FIG. 2 is a sectional view of a control valve used in the fuel pump and including the improvement of the present invention.

An annular diaphragm 11 closes pumping chamber 7. The diaphragm consists of a relatively thin disk of flexible, fuel-resistant material such as a suitable synthetic rubber. In its unstressed condition the diaphragm is essentially flat. The diaphragm is insertable into the open end of the second portion of body B. As shown in FIG. 1, the lip 9 of the pump body is bendable over the outer margin of the diaphragm to clamp the diaphragm within the pump body. The entire outer margin of the diaphragm is so clamped and the result is a fluid-tight seal between the pump body and the diaphragm.

Means, indicated generally 13, flex diaphragm 11 to pump fuel into and out of pumping chamber 7 through the respective intake and discharge cavities. Means 13 comprises a diaphragm actuating rod 15 and a spring 17. Diaphragm 11 is sandwiched between a pair of backing plates 19 and 21 respectively. Rod 15 extends through the backing plates and the diaphragm and the end of the rod is spun over. One end of spring 17 seats against the underside of plate 21. A rocker arm 23 is operable by an engine driven eccentric cam (not shown). The inner end of the rocker arm is attached to the other end of rod 15 and pulls the rod downward as it is rocked by the cam. This pulls diaphragm 11 downwardly and creates the intake stroke of the pump. Spring 17 pushes the diaphragm upwardly at the end of the intake stroke to produce the discharge stroke of the pump.

Means 13 is housed in a housing 25. The housing has a hollow conical pump head 26. The pump head has an outwardly extending circumferential rim 27, the upper face of which is downwardly and outwardly sloped. At the base of the slope is a shallow groove 29. The groove and slope form a seat for the diaphragm/pump body assembly and, in particular, the slope and groove are shaped to accomodate the bent-over portion of lip 9 after diaphragm 11 is clamped to the pump body.

A circular ring 33 which fits around the body and the housing to clamp the two together. Ring 33 has an inturned lower margin forming a lip 35. The inner face of this lip abuts the bottom outer surface of lip 27 when the pump is assembled. The ring has an upwardly extending circumferential side 37 whose height is such that the side extends beyond the joining surfaces of body B and housing 35. The upper portion of side 37 is crimped over the top of body B after the body and housing are brought into mating abutment so as to clamp the body and housing together as shown in FIG. 1.

The improvement of the present invention comprises a control valve 39 positioned in the fuel discharge cavity of the fuel pump. A control valve such as valve 39 is disclosed in U.S. Pat. No. 4,212,316, issued July 15, 1980, and assigned to the same assignee as the present invention. Control valve 39 comprises a valve body or housing 41 pressed fit into discharge cavity 1. Housing 41 consists of an inverted cylindrical cup-shaped cap 43 which fits over a seat or base 45. Cap 43 has an opening 47 with a curved peripheral surface. Cap 43 has a cylindrical sleeve portion 49 with an inner circumferential shoulder 50 on which seat 45 is received. Seat 45 has an outward projection 51 forming a seat for a spring 53. Further, the seat has a plurality of openings 55 arranged in a circular pattern about the base of the seat for flow of fuel through the valve.

A valve member 57 is movable relative to opening 47. The valve member is spherical in form and has an outer curved contact surface 59 for sealingly contacting the curved peripheral surface of opening 47 to prevent flow of a fuel through the opening. Cap 43, which is the valve seat for valve member 57, is preferably heat treated to prevent deformation of the valve seat when control valve 39 is subjected to abnormal forces such as occur during a crash. By preventing deformation of the valve seat, the sealing relationship between the valve member and the seat is maintained and the possibility of fuel leakage through opening 47 is substantially reduced.

Means indicated generally 61 are provided for sealing valve seat 43 and fuel pump body B. Means 61 comprises a circumferential groove 63 formed on the outer wall of sleeve 49. An O-ring 65 fits in groove 63 and is compressed when the control valve is press fit into the discharge cavity to form a seal between the control valve and the side wall of the cavity. The O-ring can compensate for some of the distortion which may occur between the control valve and the wall of the cavity as a result of a crash to prevent leaks around the valve. Further, O-ring 65 may be of a gasoline sensitive material which swells when contacted by fuel. Thus, even if there is substantially deformation of the fuel pump as a result of an accident, fuel is prevented from leaking through or around the control valve.

In view of the above, it will be seen that the several objects of the invention are achieved and other advantageous results obtained.

As various changes could be made in the above constructions without departing from the scope of the invention, it is intended that all matter contained in the above description and shown in the accompanying drawing shall be interpreted as illustrative and not in a limiting sense.

What is claimed is:

1. In a fuel pump for use in an automotive fuel system, the fuel pump including a body having a first portion in which is formed a fuel intake cavity and a fuel discharge cavity and a second portion in which is formed a fuel pumping chamber, one end of each cavity being in fluid communication with the pumping chamber, a flexible diaphragm closing the pumping chamber, the diaphragm being insertable into the open end of the second portion of the body, means for flexing the diaphragm to pump fuel into and out of the pumping chamber through the respective intake and discharge cavities and a housing in which the flexing means is housed, the housing having one end formed for abutment with the open end portion of the body, the improvement comprising a control valve having a valve seat pressed into the portion of the body forming the fuel discharge cavity, the valve seat having a central, circular opening with a curved peripheral surface, means for sealing the valve seat and the body, a valve member movable relative to the opening, the valve member being spherical in form with the outer curved contact surface of the valve member seatingly contacting the curved peripheral surface of the opening, a spring acting against the valve member to urge the valve member in a valve closing direction, and a seat for the spring.

2. The improvement as set forth in claim 1 wherein the sealing means comprises a circumferential groove around an outer wall of the valve seat and an O-ring fitted in the groove, the O-ring sealing against fuel leaks around the valve seat which may occur because of a crash.

* * * * *